US007104190B2

(12) United States Patent
Dahlberg

(10) Patent No.: US 7,104,190 B2
(45) Date of Patent: Sep. 12, 2006

(54) METHOD EMPLOYING HIGH KINETIC ENERGY FOR WORKING OF MATERIAL

(75) Inventor: Anders Dahlberg, Göteborg (SE)

(73) Assignee: Morphic Technologies Aktiebolag (publ), Karlskoga (SE)

( * ) Notice: Subject to any disclaimer, the term of this patent is extended or adjusted under 35 U.S.C. 154(b) by 0 days.

(21) Appl. No.: 10/476,213

(22) PCT Filed: Apr. 24, 2002

(86) PCT No.: PCT/SE02/00791

§ 371 (c)(1),
(2), (4) Date: Oct. 28, 2003

(87) PCT Pub. No.: WO02/090015

PCT Pub. Date: Nov. 14, 2002

(65) Prior Publication Data

US 2004/0134254 A1 Jul. 15, 2004

(30) Foreign Application Priority Data

May 10, 2001 (SE) ..... 0101623

(51) Int. Cl.
*B30B 13/00* (2006.01)
*E21B 7/00* (2006.01)

(52) U.S. Cl. ..... 100/35; 100/52; 173/1

(58) Field of Classification Search ..... 173/1; 72/453.01, 453.18; 100/269.16, 35, 269.14, 100/269.01, 48, 50, 52
See application file for complete search history.

(56) References Cited

U.S. PATENT DOCUMENTS

| | | | | |
|---|---|---|---|---|
| 3,584,496 | A * | 6/1971 | Keller | 72/430 |
| 3,584,498 | A * | 6/1971 | Beche | 72/453.18 |
| 3,596,499 | A * | 8/1971 | Sauerbrey | 72/407 |
| 3,600,921 | A * | 8/1971 | Schwarz | 72/56 |
| 3,898,834 | A * | 8/1975 | Kramer | 72/453.13 |
| 4,344,313 | A * | 8/1982 | Chachin et al. | 72/453.1 |
| 2002/0106298 | A1 * | 8/2002 | Allroth et al. | |

FOREIGN PATENT DOCUMENTS

| | | |
|---|---|---|
| DE | 35 27 201 C1 | 10/1986 |
| EP | 0 778 110 A2 | 6/1997 |
| GB | 2 062 124 | 5/1981 |
| WO | WO 97/00751 | 1/1997 |

* cited by examiner

*Primary Examiner*—Scott A. Smith
*Assistant Examiner*—Brian Nash

(74) *Attorney, Agent, or Firm*—Michael Bednarek; Pillsbury Winthrop Shaw Pittman LLP

(57) ABSTRACT

The present invention relates to a method for material working utilizing high kinetic energy, in which a stamp or striking body transfers, by delivering a blow, high kinetic energy to a material body that is to be worked, after which a rebound of the stamp occurs. In an embodiment of the method, a measure is taken in conjunction with said blow delivered, which measure prevents said stamp from delivering an afterblow with an appreciable kinetic energy content, for the purpose of avoiding negative effects as a consequence of afterblows.

18 Claims, 8 Drawing Sheets

METHOD EMPLOYING HIGH KINETIC ENERGY FOR WORKING OF MATERIAL

TECHNICAL FIELD

The present invention relates to a method for material working utilizing high kinetic energy, comprising a non-oscillating stamp means which is driven from a starting position by an applied force for the purpose of by means of a single blow, transferring high kinetic energy to a material body which is to be worked, after which a rebound of the stamp means occurs after said blow. The invention also relates to a device for implementing the method.

STATE OF THE ART

In high-speed working, high kinetic energy is utilized for forming/working a material body. In connection with high-speed working, use is made of percussion pressing machines in which the pressing piston has a considerably higher kinetic energy than in conventional working; it often has a speed which is roughly 100 times higher or more than in conventional presses, in order to carry out cutting, punching and forming of metal components, powder compacting and similar operations. Within high-speed working, there are today a number of different principles for bringing about the high kinetic energies which are required in order to achieve the advantages the technique affords. Machines are involved which accelerate a striking body by means of compressed air or gas, a spring or hydraulics (normally also a process which is in principle gas-driven, compressed gas in a pressure accumulator accelerating the striking body via oil). This technical field has been the subject of interest for a long time. A large number of different machines and methods have been developed, as shown in, for example, WO 9700751. It has been a common feature of all these machines, irrespective of whether they have used air, oil, springs, air/fuel mixtures, explosives or electric current for acceleration, that in principle an uncontrolled process has been started, which has resulted in the striking body having been accelerated towards a tool, after which the striking body has in some way been returned after a certain time. It is also true that the. accelerating force without exception continued to act on the striking body after the first impact, which led to a number of impacts following on from the first impact occurring. These additional impacts, afterblows, are undesirable and in most cases distinctly harmful.

It has therefore been recognized that it is in principle without exception a disadvantage to subject the workpiece to be worked in a high-speed process to more than one impact, irrespective of whether it is cutting, punching, homogeneous forming or powder compacting which is involved. As far as cutting is concerned, the extra, unnecessary impact(s) can result in excessive tool wear and undesirable burrs. In the case of punching, smearing, welding, burrs and tool wear can occur. In homogeneous forming, there is a risk of undesirable material changes taking place, punches can crack and the blank is fixed unnecessarily hard in the die, which results in the pressing-out force increasing with die wear as a consequence. In powder compacting with brittle materials such as ceramics, hard metals or the like, a second impact can break the coherent body successfully created on the first impact. In powder compacting using soft powders such as, for example, copper or iron, it is indeed true that the density continues to increase when several blows are applied, but the blank is pressed increasingly firmly into the die with a greater number of impacts, which results in undesirable wear. A likely reason why this problem has not been focussed on previously could be that these operations are very rapid and in many cases could quite simply not be observed, for which reason the harmful effects of the after-blow appeared inexplicable. In addition, the extremely short response times required in order to make it possible to interrupt the acceleration of the striking body after the first impact constitute a complication in themselves. It is also true that if the striking body is accelerated by a gas, it has been in principle technically impossible to lower the pressure in the drive chamber in the short time which passes between the first and the second impacts (typically between two and fifty milliseconds). Moreover, the great majority of valves available on the market are by no means capable of reacting to a change in input signal within twenty milliseconds. As far as spring-operated machines are concerned, it is quite obvious that it is somewhat difficult to design a mechanical device which slackens off the spring preloading within a few milliseconds. Furthermore, most known hydraulic high-speed machines have been equipped with valve mechanisms which cannot be adjusted sufficiently rapidly in order to stem the rapidly advancing oil and thus the pressure build-up in the drive chamber of the piston. The reason for this is that hydraulic valves for high flow rates (300–1000 liters per minute) normally require extremely long adjustment times. This is in turn due to the fact that the valve body quite simply has to move a long distance in order for a sufficiently large opening area to be formed for it to be possible for the oil to pass through it without excessive pressure drop.

BRIEF DESCRIPTION OF THE INVENTION

It is an object of the present invention to eliminate or at least minimize the abovementioned problems, which is achieved by a method for material working utilizing high kinetic energy, comprising a non-oscillating stamp means which is driven from a starting position by an applied force for the purpose of by means of a single blow, transferring high kinetic energy to a material body which is to be worked, after which a rebound of the stamp means occurs, characterized in that a measure is taken in conjunction with said blow delivered, which measure prevents said stamp means delivering an afterblow with an appreciable kinetic energy content, for the purpose of avoiding negative effects as a consequence of afterblows, after which the stamp means is returned to said starting position.

Owing to the solution, a method is obtained, by means of which high-speed working can be carried out in a way which provides higher quality than has previously been known.

DESCRIPTION OF FIGURES

The invention will be described in greater detail below with reference to the accompanying figures, in which.

DETAILED DESCRIPTION

Figure 1:
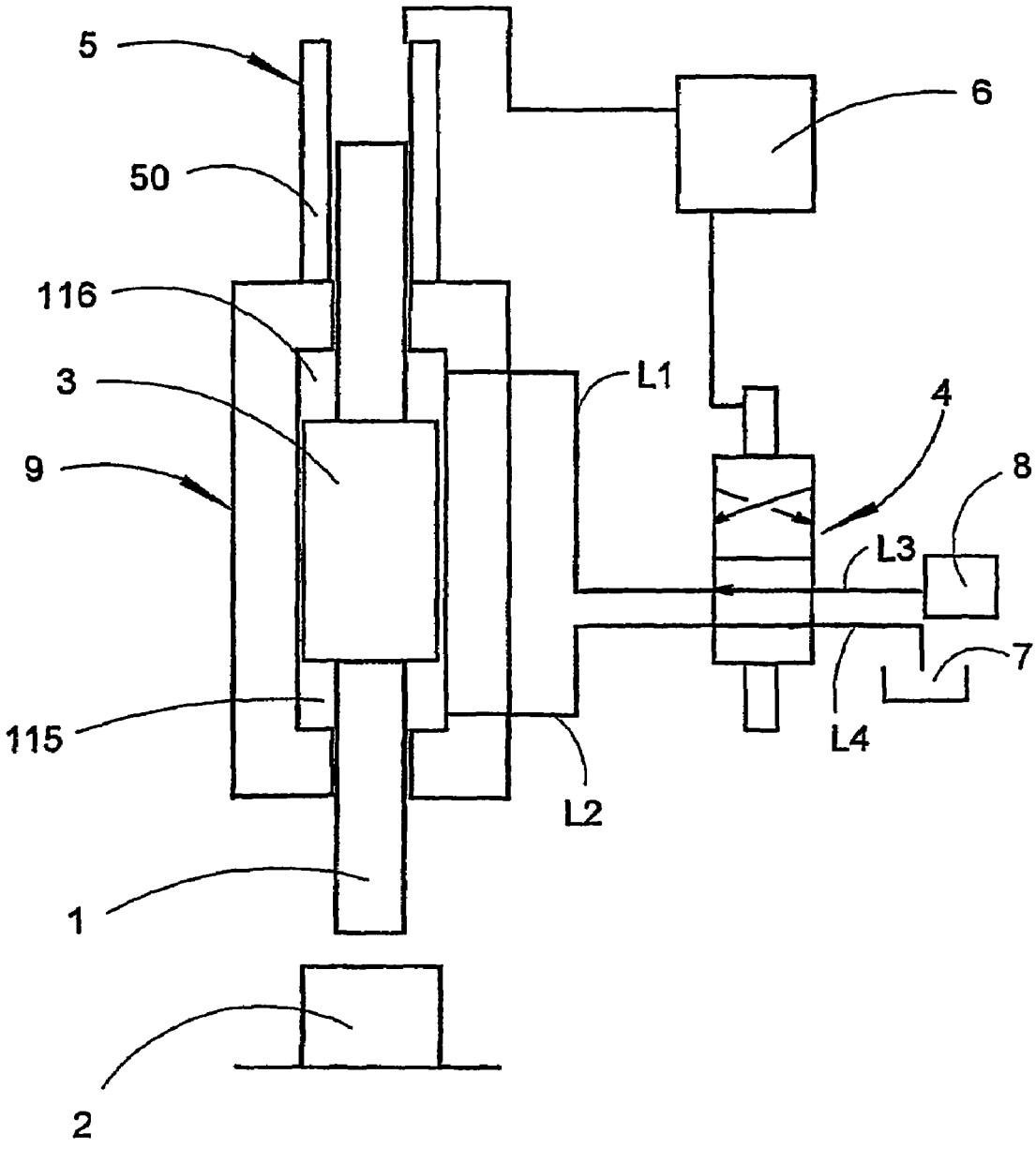
FIG. 1 shows the principles of a percussion pressing machine according to the invention.

FIG. 1 shows a first preferred embodiment according to the invention. A hydraulic piston/cylinder unit 9 is shown, with a hydraulic piston 3 which is provided, at its lower end, with a stamp means 1. This stamp means 1 is intended to transfer high kinetic energy to a material body 2 (or tool) for high-speed working. The diagrammatic FIG. also shows that the piston/cylinder unit 9 is provided with a lower pressure: chamber 115 and an upper pressure chamber 116. The upper pressure chamber 116 is connected to a valve means 4 via a first line L1. The lower chamber 115 is connected to the same valve means 4 via a second line L2. On its other side, the valve means 4 is connected, via a third line L3, to a pressure source 8 and, via a fourth line L4, to a tank 7 (in most cases atmospheric pressure). In a first position (shown in FIG. 1), the valve means couples the pressure source 8 together with the first line L1 so that the upper chamber 116 is pressurized. At the same time, the lower chamber 115 is coupled to the tank 7. In this position of the valve means 4, the hydraulic piston 3 will therefore be acted on by a downwardly directed accelerating force. In a second position of the valve means 4 (not shown), a reversed coupling of the lines L1, L2 is brought about, which means instead that the lower pressure chamber 115 is connected to the pressure source 8 and the upper pressure chamber 116 is connected to the tank 7. In this position, the piston 3 is therefore accelerated upwards instead. The figure also shows that the valve means 4 is coupled to a control/regulating unit 6. This control/regulating unit 6 receives signals from a sensing means 5 which, in the example shown, consists of a position sensor 50.

The invention functions in the following manner. In a starting position, the valve means 4 has, by means of the control/regulating unit 6, been positioned in its second position, that is to say so that the hydraulic piston 3 is positioned in its uppermost position inside the piston/cylinder unit 9. When it is then desirable to deliver a blow with the stamp means 1 to a material body 2, the control/regulating unit 6 will act on the valve means 4 to cause it to change position to its first position (see FIG. 1), the upper pressure chamber 116 then being connected to the pressure source 8. This pressure source suitably consists of an arrangement comprising a hydraulic pump which is connected to an accumulator, in which the high pressure necessary for high-speed working is always maintained.) Owing to the pressurization in the pressure chamber 116, the hydraulic piston 3 will therefore be accelerated rapidly to very high speed before the stamp means 1 strikes the tool/material body 2. By means of the position sensor 50, which is in constant communication with the control/regulating unit 6, the position of the hydraulic piston 3, and thus the stamp means 1, can be sensed. In a given predetermined position P1 of the hydraulic piston 3, which is identified by the position sensor 50, a signal is given to the control/regulating unit 6 which then acts on the valve means 4 to cause it to change position, to said second position, so that the hydraulic piston 3 will move towards and/or remain in its upper position. By means of the invention, the process can therefore be controlled so that only one blow is brought about during working, by virtue of which undesirable effects on account of afterblows are eliminated.

Figure 2:
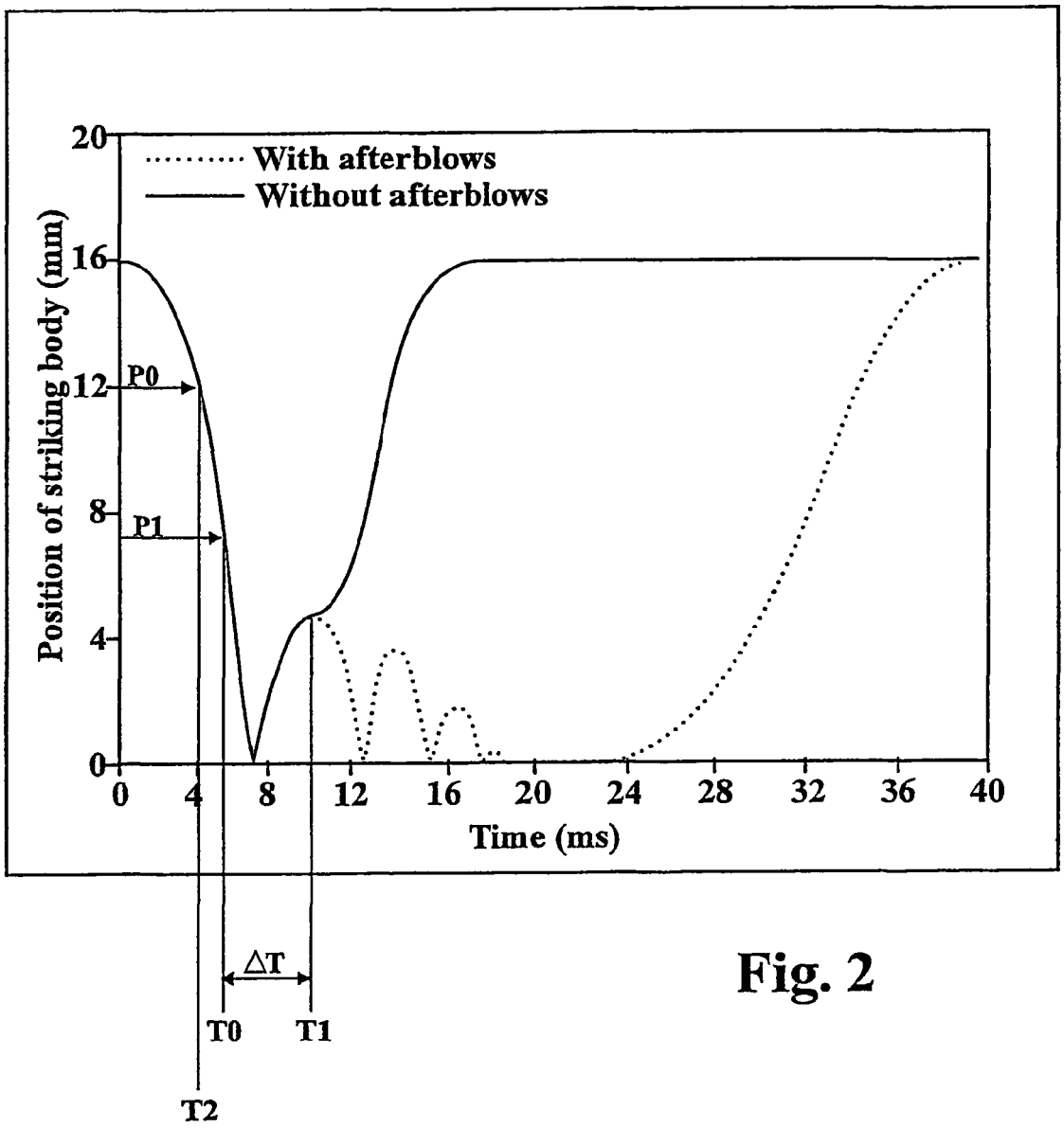
FIG. 2 shows a diagram which illustrates the movement of the stamp means in connection with carrying out a striking operation, where one curve shows the movement without the invention activated and another curve shows the movement with the invention activated.

FIG. 2 shows a diagram in which the position of the striking body (the stamp means) has been plotted schematically along a time axis during delivery of a blow. The solid line shows a blow delivered according to the invention, and the broken line shows how a conventional blow takes place. It can be seen that the two curves coincide during a first time period, that is to say exactly the same acceleration and movement are brought about from the starting position (time=0) to the delivery of a blow (time roughly 6 ms), and during the return movement/rebound (time roughly 9 ms). According to the conventional method (broken line), a number of afterblows will then occur, that is to say the stamp means will deliver an additional number of blows of varying power to the tool/material body, which, as mentioned, has been found to be capable of producing undesirable consequences in the form of, for example, increased tool wear, undesirable burrs, smearing, crack formation etc. The reason is that the pressure chamber 116 according to conventional art is still very highly pressurized after the first blow, and the enormous energies which are transferred in connection with the blow give rise to various kinds of oscillation in the system, as a result of which said series of afterblows occurs. According to the invention, this is avoided by virtue of the valve means 4 being repositioned in conjunction with said blow delivered, so that the pressurization in the upper chamber 116 ceases before there is time for an afterblow to be delivered. According to the embodiment shown in FIG. 1, this is brought about by, at a first time T0 (see FIG. 2) which is identified by means of the position sensor 50, a signal being given via the control/regulating unit 6 to the valve means 4 to change position. By virtue of the fact that the valve means 4 has a certain inherent inertia, the changed position will be adopted after a certain time $\Delta T$. According to the example shown, $\Delta T$ is roughly 4 ms, which means that the valve means 4 is repositioned by the time T1. In the example shown, T1 has been selected to occur when the stamp means 1 is situated at the highest level after a first rebound. The speed of the hydraulic piston is 0, or close to 0, at precisely this time. Owing to this fact, unnecessary pressure peaks in the hydraulic system can be avoided in connection with the repositioning, as a result of which undesirable pressure transients can therefore be eliminated, which is an advantage from the point of view of service life. It is also advantageous to select this position because, for in principle every machine type and application, the blow has, with its first rebound, a certain predetermined duration, that is to say the unavoidable rebound reaches its maximum height (0 speed) after a certain time, calculated from the hydraulic piston 3 having passed a certain position during the striking movement. As these parameters are determined by the accelerating force and the mass and elasticity of the components involved, the parameters are intrinsically stable and repeatable, and the control system can therefore be adjusted so that the valve means 4 is changed over to its second position at the correct time. Preferably, then, a time close to when the speed of the striking body is zero is therefore selected.

It will be understood, however, that this in no way limits the invention, but that the purpose of the invention is to eliminate afterblows with an appreciable kinetic content, which can give rise to undesirable effects. It is thus also possible, therefore, to envisage, instead of pressurization in the lower chamber 115 at the same high level as the upper pressure chamber, making use of a connection to a lower-pressure source, for the lower pressure chamber 115, for the purpose of bringing about sufficient damping of the rebound movement in order to avoid negative consequences. According to such an embodiment, use can be made of; for example, a three-way valve and a further pressure source (not shown), the valve, when repositioned, shutting off all communication with the higher-pressure source 8, connecting the lower pressure chamber 115 to a lower-pressure source (not shown) and connecting the upper chamber 116 to the tank 7.

Figure 3:
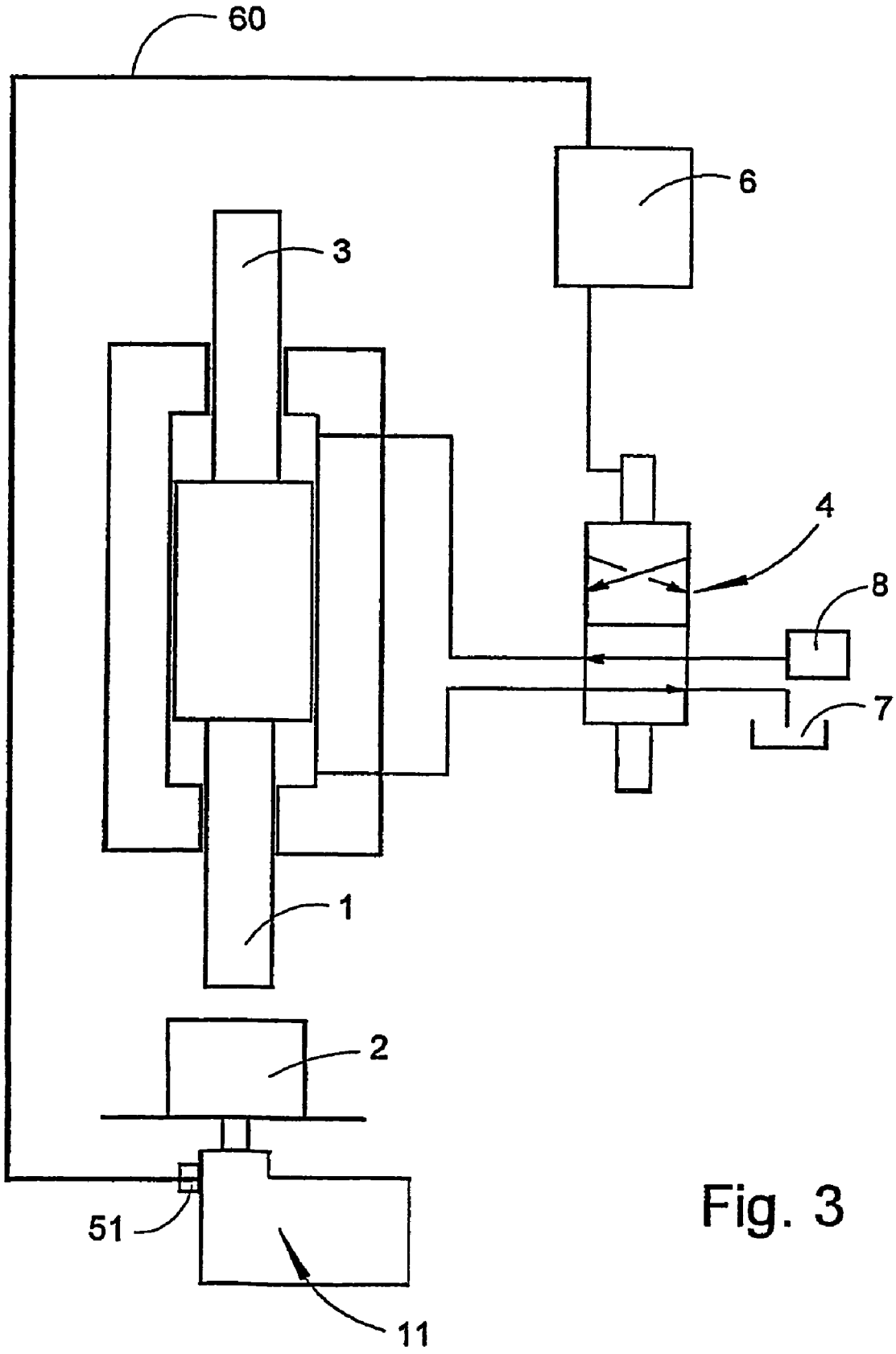
FIG. 3 shows the device with a first alternative sensing means.

FIG. 3 shows an alternative implementation according to the invention. The basic principle of the system is substantially the same as for that shown in FIG. 1. It can be seen that, in addition to what is shown in FIG. 1, use is made of a damper 11, which is virtually always used when the stamp means strikes a tool 2 containing the material body. The purpose of the damper is to intercept/brake the tool movement after a blow has been delivered. According to the invention, a pressure sensor 51, which can act as a sensing means 5 for the system, is connected to this damper 11. When a blow is delivered by the stamp means 1 to the tool/material body 2, the striking movement will be transmitted down through the tool/the material body 2 and then act on the damper 11, which is hydraulic, the hydraulic oil in the damper 11 then acting on the pressure sensor 51 to cause it to give a signal to the control/regulating unit 6 via a line 60. The control/regulating unit 6 then acts on the valve means 4 to cause it to reposition, in accordance with what was described above. It can be seen that an embodiment according to FIG. 3 requires a shorter adjustment time for the valve means 4 than a system according to FIG. 1. This embodiment can therefore be used only when very rapid valve means 4 are used, for example a valve means as described in SE 0002038-8.

Figure 4:
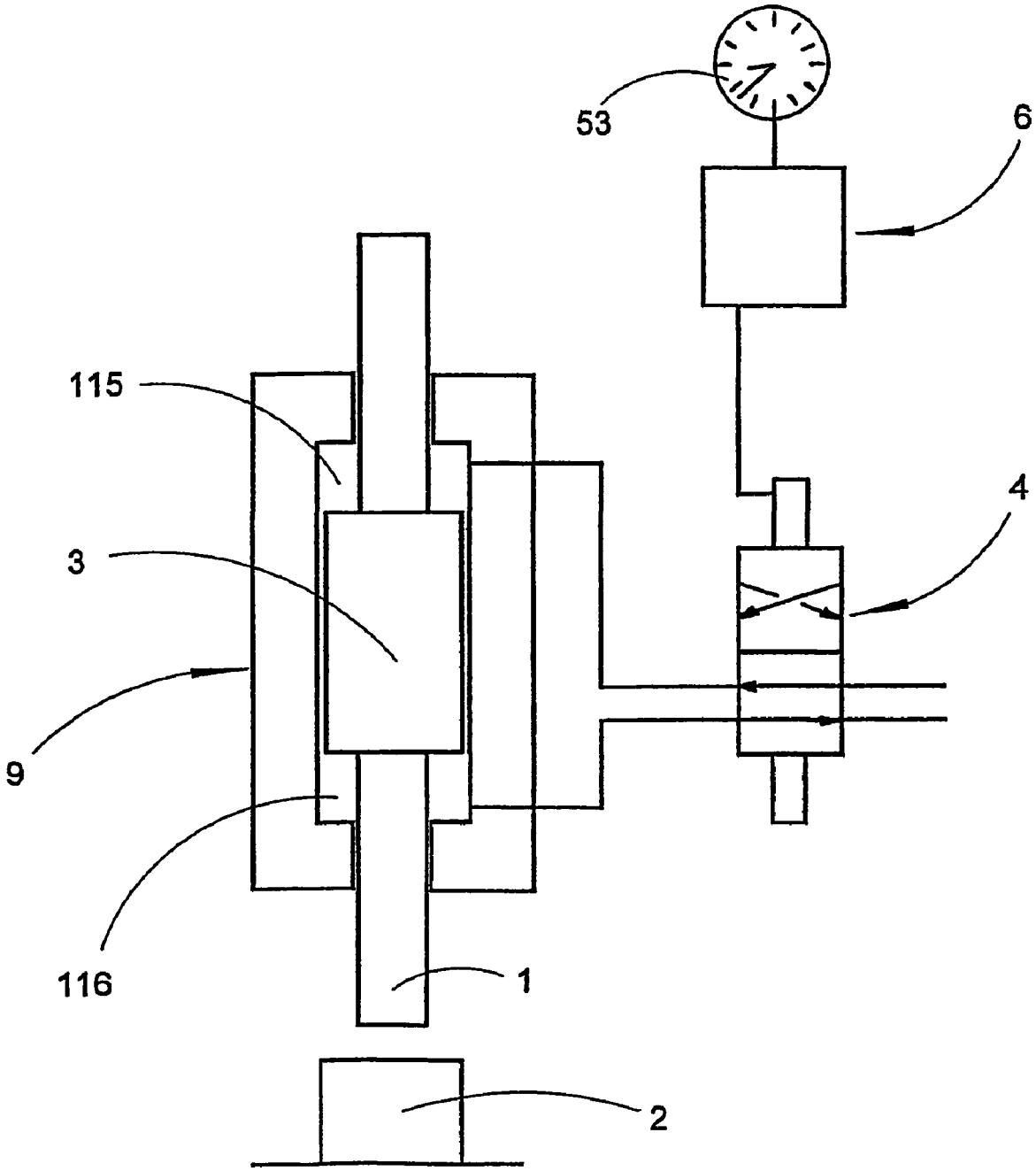
FIG. 4 shows the use of a second alternative sensing means.

FIG. 4 shows another modification according to the invention. In this case, use is made of a sensing means 5 in the form of a timing circuit 53 in order to initiate repositioning of the valve means 4 at the correct moment, for the purpose of avoiding afterblows. Use is suitably made of the starting time (0 in FIG. 2) of the striking operation in order, by means of empirical data, to determine at which time T0 after the starting moment the timing circuit 53 is to give a signal for repositioning to the valve means 4. According to the operation shown in FIG. 2, a signal should therefore be given to the valve means 4 roughly 2.5 ms after initiation of a blow.

Figure 5:
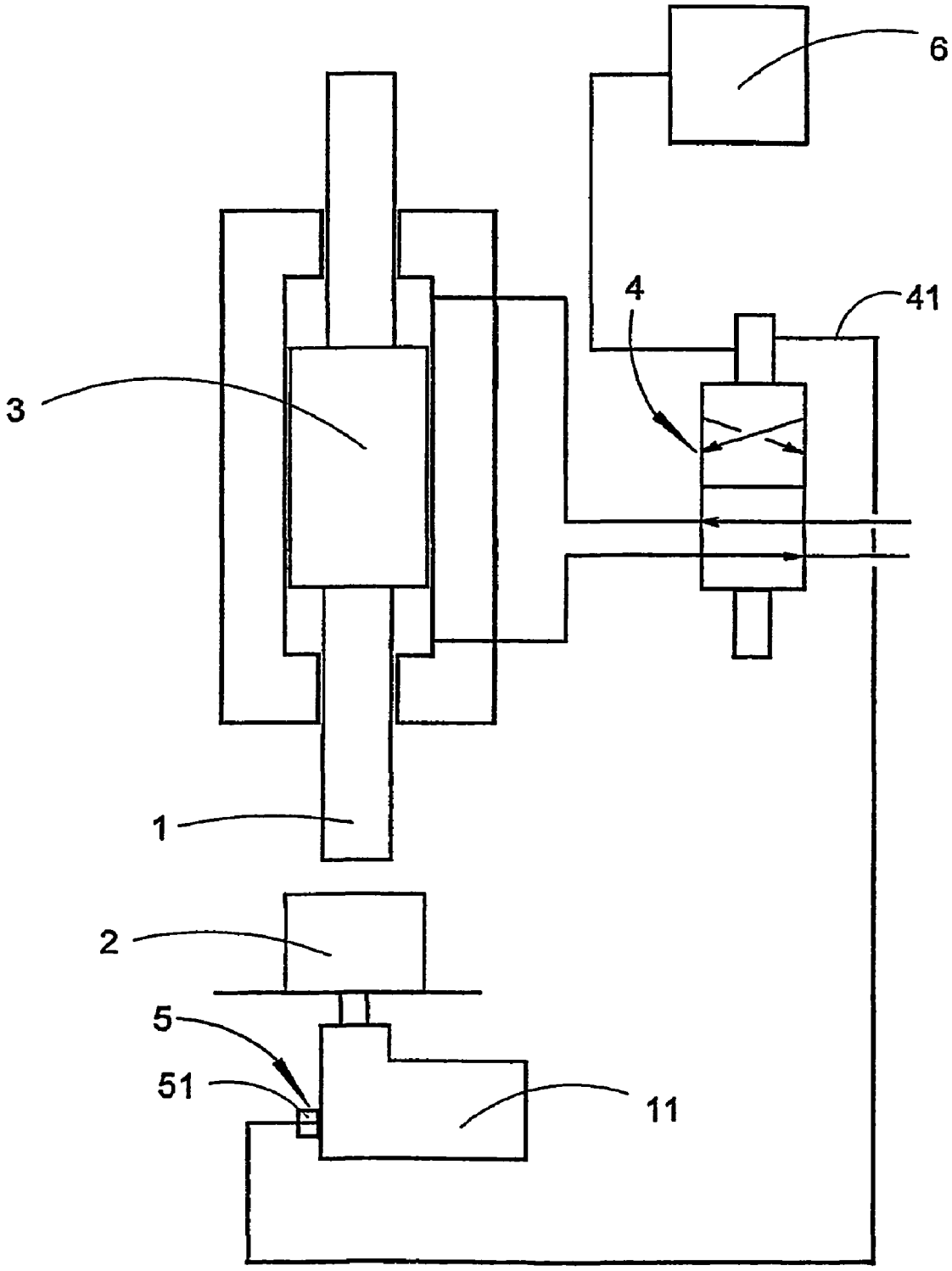
FIG. 5 shows a modified control arrangement for implementing the invention.

FIG. 5 shows a further modification, in which use is made of direct coupling between the sensing means 5 and the valve means 4, in the form of a hydraulic line 41. In this case, use is therefore made of the pressure peak obtained in the damper 11 in order to reposition the valve means 4 directly. Alternatively, the line 41 can consist of an electronic/electric circuit which, on a signal from a pressure sensor 51, acts directly on an activating means of the valve means 4 to bring about its repositioning.

Figure 6:
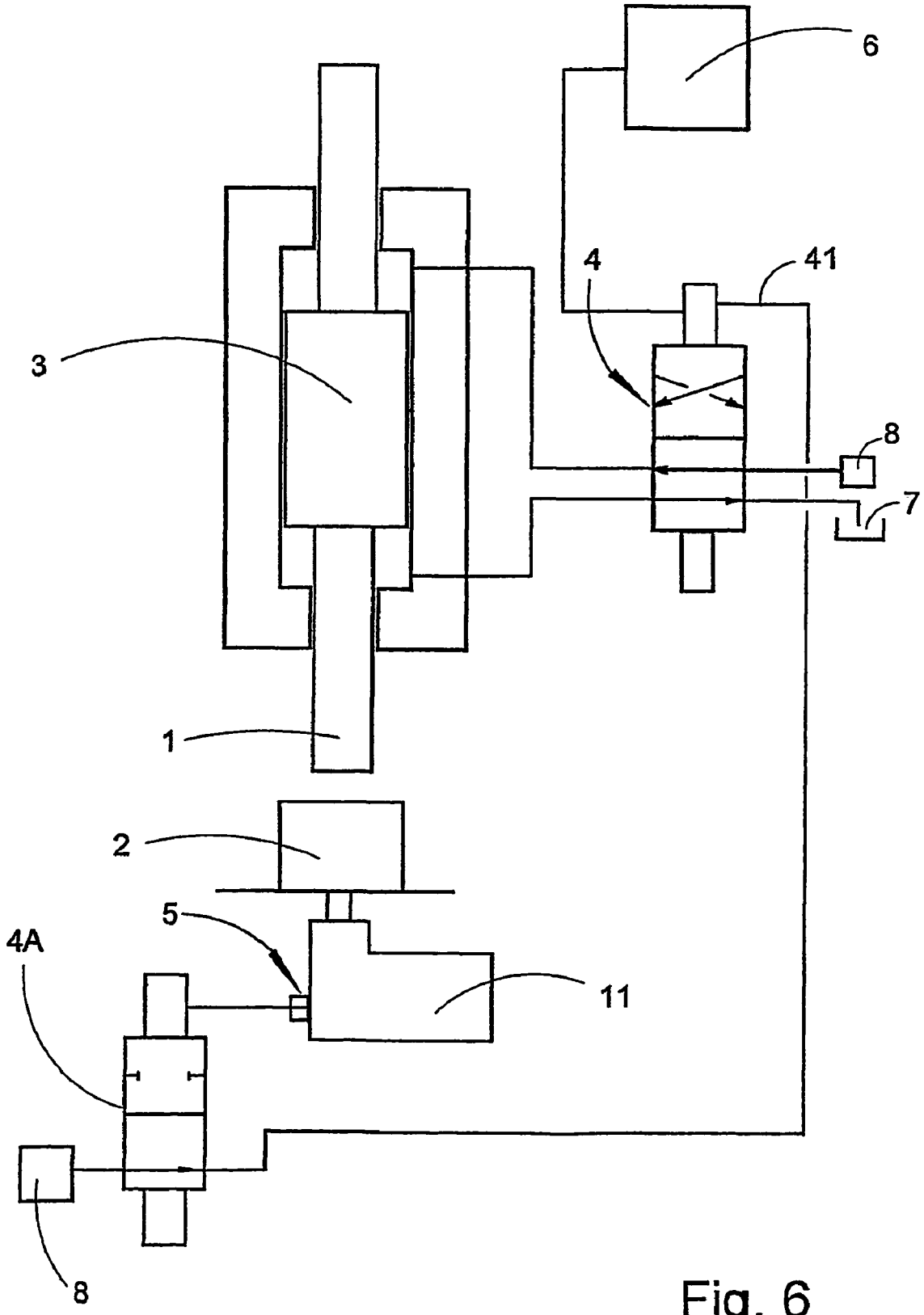
FIG. 6 shows an alternative embodiment of the arrangement according to FIG. 5.

FIG. 6 shows a further modification, in which use is made of two valve means 4, 4A coupled in series in the line 41, in order to make it possible to bring about repositioning of the valve means 4. In this case, use is suitably made of the same pressure source 8 which is acted on by the valve means 4 which controls the striking piston 3. The extra valve 4A, which can be made extremely small, controls only the activation of the valve means 4 in connection with a blow being registered by the damper 11.

Figure 7:
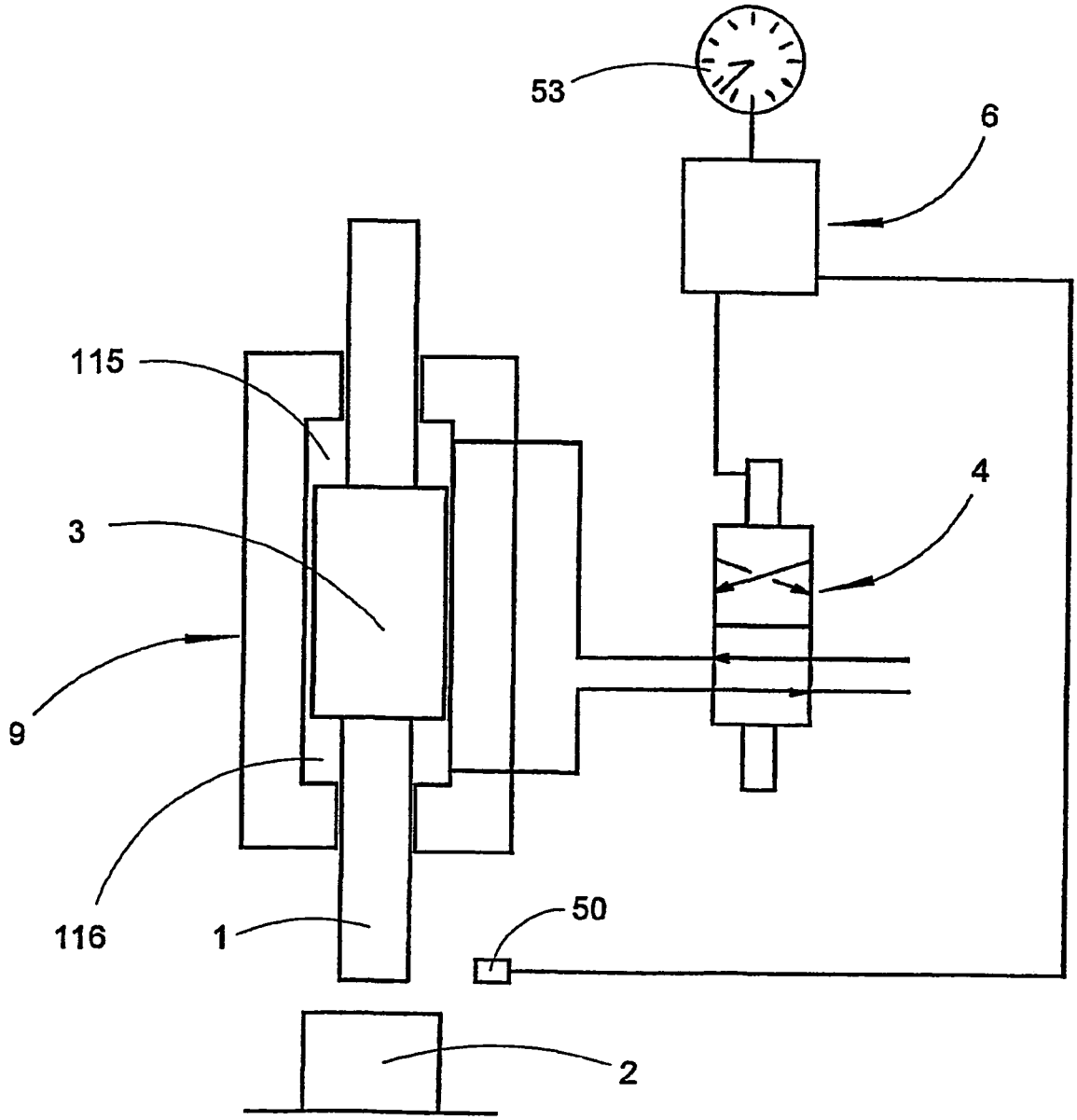
FIG. 7 shows a preferred combination of sensing means.

FIG. 7 shows a further possibility according to the invention, namely that of using a combination of sensing means 5. In this case, the figure shows that use is made of a combination of sensing means according to FIG. 1 and FIG. 4, that is to say a combination of a position sensor 50 and a timing circuit 53. In this case, the position sensor 50 is made to control the starting point for the timing circuit, which in some situations can provide even greater accuracy, for example owing to the fact that the initial starting cycle can vary to a greater or lesser extent. FIG. 2 shows diagrammatically a suitable implementation according to the invention. The position sensor, for example an optical sensor, is therefore arranged 4 mm below the starting position of the stamp means 1. When the striking body has been moved to P0, that is to say 4 mm from its starting position (or, put another way, has a further 12 mm to move towards the tool/material body 2), the position sensor 50 will give a signal to the timing circuit 53, which takes place at the time T2. From T2, the control and regulating unit 6 then activates the valve means 4 so that it begins repositioning at the time T0. This combination of sensing means increases the flexibility of the system because, when a parameter of the system is changed (for example a different stamp means), it is simple and quick to readjust the system as only a modified time parameter has to be programmed into the control/regulating unit 6. It is not then necessary for any physical movement of; for example, the position sensor 50 to take place.

Figure 8:
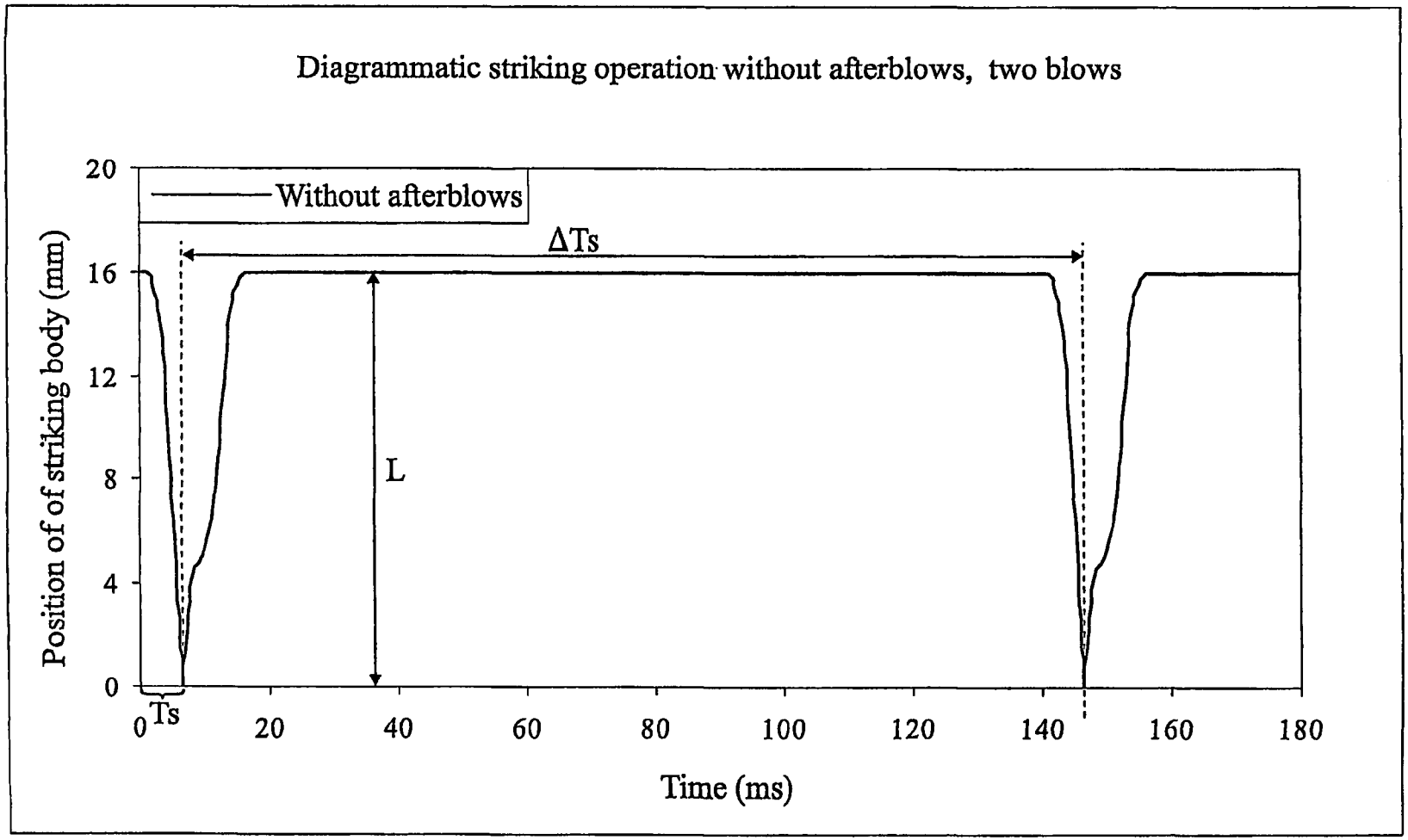
FIG. 8 shows diagrammatically a striking operation according to the invention without afterblows.

FIG. 8 shows a diagram in which the position of the striking body (the stamp means) has been plotted schematically along a time axis during delivery of two successive blows. It can be seen that the striking movement takes place over a very short time, roughly 5–10 ms, and that, after a blow has been delivered, the striking body is returned from the striking position the whole distance L to the starting position without any afterblow being delivered. A relatively long time $\Delta T_s$ then passes before the next blow is delivered. It can therefore be seen that the interval between two blows $\Delta T_s$ is considerably longer than the time Ts required to deliver a blow.

The invention is not limited to what is shown above but can be varied within the scope of the patent claims below. It will therefore be understood that a great many variants of the sensing means 5 can be combined in a number of different ways in order to adapt the device to different situations. It is also clear that a number of different kinds of sensing means in addition to those described above can be used, for example acoustic sensors, accelerometers etc.

The expression applied force means a force other than gravitational force. It is also clear that sensors can be designed in many different known ways; the position sensor can be inter alia analogue or digital, mechanical, optical, inductive or capacitive, either binary or relative or absolute. It is clear too that a pressure sensor according to FIG. 4 can be arranged in one or a number of different places, for example in the pressure chamber 115. Lastly, it will be understood that the method is not limited to hydraulic devices but that it is entirely possible to apply the invention using mechanical arrangements in other drive devices as well, for example gas-driven or spring-operated devices. It is furthermore clear that the invention is also suitable for opposite piston arrangements, jumping anvils etc.

The invention claimed is:

1. A method for working a material body using high kinetic energy, the method comprising:

applying a hydraulic force to a stamp to drive the stamp from a starting position to the material body in a first duration;

delivering a single blow of the stamp to the material body, the single blow causing the stamp to rebound;

preventing the stamp from delivering to the material body an afterblow of a kinetic energy content greater or equal to that of the single blow, wherein preventing the stamp from delivering the afterblow comprises controlling the force applied to the stamp in response to at least one signal received from a sensor; and returning the stamp to the starting position in a second duration, the second duration being substantially longer than the first duration.

2. The method of claim 1, wherein preventing the stamp from delivering an afterblow comprises one of:

substantially reducing the applied force after the blow has been delivered and before returning the stamp to the starting position; and substantially reversing the applied force after the blow has been delivered and before returning the stamp to the starting position.

3. The method of claim 2, wherein the one of substantially reducing and reversing the applied force occurs substantially concurrent with a moment when the stamp is at its turning point after a first rebound.

4. The method of claim 1, the sensor sensing at least one of hydraulic oil pressure, vibrations, time, and position.

5. The method of claim 1, the sensor comprising a sensor that measures a hydraulic oil pressure of a damper on which the stamp acts and transmits the at least one signal in response to measuring a predetermined pressure.

6. The method of claim 1, wherein the stamp is driven hydraulically, and wherein preventing the stamp from delivering an afterblow comprises actuating a valve.

7. The method of claim 1, further comprising delivering a second blow of the stamp, the two successive blows separated in time by a time difference ($\Delta T_s$) that considerably exceeds a time $T_s$ required to drive the stamp from its starting position to the material body.

8. The method of claim 1, further comprising holding the material body substantially stationary.

9. The method of claim 1, wherein the single blow is instantaneous.

10. A device for working a material body using high kinetic energy, the device comprising:

a stamp;

a drive unit coupled to the stamp, the drive unit configured to apply a hydraulic force that drives the stamp from a starting position to the material body in a first duration; and a regulator coupled to the drive unit, the regulator controlling the force applied by the driving unit, wherein the regulator is configured to one of substantially reduce and reverse the applied force on the stamp substantially concurrent with delivery of a single blow by the stamp to prevent the stamp from delivering to the material body an afterblow of a kinetic energy content greater or equal to that of the single blow, after the stamp rebounds, the regulator comprising at least two communicating valve devices that prevent the stamp from delivering the afterblow, and wherein the stamp is configured to return to the starting position in a second duration, the second duration being substantially greater than the first duration.

11. The device of claim 10, the drive unit comprising at least one hydraulic piston/cylinder unit.

12. The device of claim 10, the material body remaining substantially stationary with respect to the stamp.

13. The device of claim 10, further comprising a support that holds the material body substantially stationary.

14. A device for working a material body using high kinetic energy, the device comprising:

a stamp:

a drive unit coupled to the stamp, the drive unit configured to apply a hydraulic force that drives the stamp from a starting position to the material body in a first duration;

a regulator coupled to the drive unit, the regulator controlling the force applied by the driving unit, wherein the regulator is configured to one of substantially reduce and reverse the applied force on the stamp substantially concurrent with delivery of a single blow by the stamp to prevent the stamp from delivering to the material body an afterblow of a kinetic energy content greater or equal to that of the single blow, after the stamp rebounds, wherein the stamp is configured to return to the starting position in a second duration, the second duration being substantially greater than the first duration;

a control unit controlling the regulator; and a sensor in communication with the control unit, the control unit, in response to a signal from the sensor, actuating the regulator such that the regulator is configured to one of substantially reduce and reverse the applied force on the stamp substantially concurrent with the delivery of the blow by the stamp.

15. The device of claim 14, the regulator comprising at least one valve.

16. The device of claim 14, the sensor comprising at least one of a position sensor, a pressure sensor, an accelerometer, and an acoustic sensor.

17. The device of claim 14, the sensor comprising a timing circuit that is activated substantially concurrent with the blow to prevent the stamp from delivering the afterblow.

18. The device of claim 14, the sensor comprising a sensor that measures a hydraulic oil pressure of a damper on which the stamp acts and transmits the signal in response to measuring a predetermined pressure.

* * * * *